US006580345B2

(12) United States Patent
Akita et al.

(10) Patent No.: US 6,580,345 B2
(45) Date of Patent: Jun. 17, 2003

(54) SWITCHING DEVICE

(75) Inventors: Hiroyuki Akita, Tokyo (JP); Toyomi Ooshige, Tokyo (JP); Hiroyuki Sasao, Tokyo (JP); Kenichi Koyama, Tokyo (JP); Yukimori Kishida, Tokya (JP); Mitsuru Tsukima, Tokyo (JP); Toshie Takeuchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 58 days.

(21) Appl. No.: 09/867,751

(22) Filed: May 31, 2001

(65) Prior Publication Data

US 2002/0044036 A1 Apr. 18, 2002

(30) Foreign Application Priority Data

Oct. 16, 2000 (JP) ..... 2000-315191

(51) Int. Cl.[7] ..... H01H 53/00

(52) U.S. Cl. ..... 335/147; 335/148; 335/223; 218/141

(58) Field of Search ..... 335/147–150, 335/177, 178, 180–184, 223–226; 218/120, 141, 142

(56) References Cited

U.S. PATENT DOCUMENTS

| | | | | |
|---|---|---|---|---|
| 4,086,645 | A | 4/1978 | Gorman et al. | |
| 6,046,423 | A | 4/2000 | Kishida et al. | |
| 6,295,191 | B1 | 9/2001 | Kishida et al. | |
| 6,353,376 | B1 * | 3/2002 | Takeuchi et al. | 218/141 |

FOREIGN PATENT DOCUMENTS

| | | |
|---|---|---|
| DE | 3910010 | 10/1989 |

* cited by examiner

*Primary Examiner*—Ramon M. Barrera
(74) *Attorney, Agent, or Firm*—Leydig, Voit & Mayer, Ltd.

(57) ABSTRACT

A switching device includes a movable coil which is reinforced by a stiffener to increase the resistance of the movable coil to bending moments. The stiffener may include a nonmagnetic case which surrounds the movable coil. Alternatively or in addition, it may include a resin or other material encapsulating the movable coil.

17 Claims, 5 Drawing Sheets

SWITCHING DEVICE

REFERENCE TO RELATED APPLICATIONS

This application is based on Japanese Patent Application No. 2000-315191, filed in Japan on Oct. 16, 2000, the contents of which are hereby incorporated by reference.

BACKGROUND OF THE INVENTION

1. Field of the Invention

This invention relates to a switching device which employs electromagnetic repulsion to generate a drive force to produce relative movement of a pair of contacts into or out of contact with each to close or open an electric circuit.

2. Description of the Related Art

FIGS. 10*a* and 10*b* are schematic cutaway elevations of a switching device known to the inventors which utilizes electromagnetic repulsive force in a closed contact state and an open contact state, respectively. The illustrated switching device includes a switch portion 3 which can open and close an electric circuit, a movable shaft 5 which transmits a drive force to the switch portion 3, and an operating mechanism 9 which is driven by an unillustrated electric power supply and applies a drive force to the movable shaft 5 to open and close the switch portion 3.

The switch portion 3 includes a fixed contact 1 which is secured to a support plate 16 and a movable contact 2 which is disposed opposite the fixed contact 1. In order to obtain good arc extinguishing properties for the switch portion 3, the contacts 1 and 2 are housed in an evacuated chamber 4. A first terminal 14 is electrically connected to the fixed contact 1, and a second terminal 15 is electrically connected to the movable contact 2. The switch portion 3 can be electrically connected to an external electric circuit through these terminals 14 and 15.

The movable shaft 5 includes a live portion 6 connected to the movable contact 2 and a non-live portion 7 connected to the operating mechanism 9. The live portion 6 and the non-live portion 7 are connected to and electrically insulated from each other by an electrically insulating rod 8 which prevents current from flowing from the switch portion 3 to the operating mechanism 9.

The operating mechanism 9 includes a contact opening fixed coil 11 which is secured to a stationary support plate 17, a contact closing fixed coil 12 which is secured to another stationary support plate 18, a movable coil 10 which is secured to the movable shaft 5 and which is disposed between the contact opening fixed coil 11 and the contact closing fixed coil 12, and a bidirectional biasing spring 13 which is secured to a support plate 19 and to the non-live portion 7 of the movable shaft 5. The movable shaft 5 loosely passes through support plate 17 and support plate 18, so the movable coil 10 can reciprocate between the contact opening fixed coil 11 and the contact closing fixed coil 12. The biasing spring 13 is a non-linear spring which exerts a biasing force which changes in direction depending on the position of the movable shaft 5. When the movable shaft 5 is in the raised position shown in FIG. 10*a,* the biasing spring 13 exerts an upwards biasing force on the movable shaft 5 to maintain the contacts of the switch portion 3 in a closed state, and when the movable shaft 5 is in the lowered position shown in FIG. 10*b,* the biasing spring 13 exerts a downwards biasing force on the movable shaft 5 to maintain the contacts of the switch portion 3 in an open state.

Next, contact opening operation will be explained. When the switching device is in the closed contact state shown in FIG. 10*a,* if a pulse current from the unillustrated power supply is supplied to the contact opening fixed coil 11 and the movable coil 10, these coils 11 and 10 generate magnetic fields which produce electromagnetic repulsive forces which repel the coils 11 and 10 from each other. The movable coil 10 is pushed downwards in the figure by the electromagnetic repulsive forces, and the movable shaft 5 which is secured to the movable coil 10 and the movable contact 2 which is connected to the movable shaft 5 also move downwards, causing the movable contact 2 to separate from the fixed contact 1, and contact opening of the switch portion 3 takes place. When the movable shaft 5 moves downwards past a prescribed point, the direction in which the biasing spring 13 exerts a biasing force on the movable shaft 5 changes from the contact closing direction (upwards in the figure) to the contact opening direction (downwards in the figure), so when the contacts 1 and 2 of the switch portion 3 are separated from each other, the biasing spring 13 maintains the switch portion 3 in an open contact state as shown in FIG. 10*b.*

Next, contact closing operation will be explained. When the switching device is in the open contact state shown in FIG. 10*b,* if a pulse current from the power supply is supplied to the contact closing fixed coil 12 and the movable coil 10, magnetic fields are generated by these coils 12 and 10, and the magnetic fields produce electromagnetic repulsive forces which repel coils 12 and 10 from each other. The movable coil 10 is pushed upwards in the figure by the electromagnetic repulsive forces, the movable shaft 5 and the movable contact 2 move upwards with the movable coil 10, and the movable contact 2 contacts the fixed contact 1 to perform contact closing of the switch portion 3. When the movable shaft 5 moves upwards past a prescribed point, the direction in which the biasing spring 13 exerts a biasing force on the movable shaft 5 changes from the contact opening direction (downwards in the figure) back to the contact closing direction (upwards in the figure), so when the contacts 1 and 2 of the switch portion 3 are in contact with each other, the biasing spring 13 maintains the switch portion 3 in the closed contact state shown in FIG. 10*a.*

In the switching device of FIGS. 10*a* and 10*b*, contact opening and closing operations are carried out by electromagnetic repulsion between opposing coils, so the speed of operation is high. As a result of the collision through magnetic force between opposing coils occurring during this high speed operation, large impacts are applied to the coils, and the coils can be damaged by these impacts.

Since the movable coil 10 is flat, it is subjected to a large bending moment near its longitudinal axis. If the thickness of the movable coil is increased in order to increase its stiffness and its resistance to impacts, the center-to-center distance between opposing coils (the distance between two opposing coils measured from halfway through the thickness of one coil to halfway through the thickness of the opposing coil) increases, and electromagnetic repulsive forces cannot be efficiently generated. Furthermore, increasing the thickness of the movable coil increases the overall size of the switching device in the axial direction, making the switching device more cumbersome.

SUMMARY OF THE INVENTION

An object of the present invention is to provide a switching device which prevents damage to opposing coils of the switching device due to impacts during contact opening or contact closing operation.

Another object of the present invention is to provide a switching device having coils which can efficiently generate electromagnetic repulsive forces.

Yet another object of the present invention is to provide a switching device which is highly reliable and has good high speed responsiveness.

According to one form of the present invention, a switching device includes a switch portion having a fixed contact and a movable contact, a movable shaft drivingly connected to the movable contact, and an operating mechanism drivingly connected to the movable shaft and moving the movable shaft to open and close the switch portion. The operating mechanism includes a flat movable coil operatively connected to the movable shaft, a fixed coil opposing the movable coil, and a coil stiffener which increases the stiffness of the movable coil against forces in the axial direction of the movable shaft.

In preferred embodiments, the movable coil has an outer diameter which is approximately 9–11 times its thickness.

The coil stiffener may have a variety of configurations. In one form of the invention, the coil stiffener comprises a resin molded around the movable coil. In another form of the invention, the coil stiffener comprises a varnish applied to the movable coil.

The coil stiffener may include a case which houses the movable coil. In preferred embodiments, the case comprises a nonmagnetic metal.

The case may include radially-extending slits or grooves in a surface thereof which opposes a fixed coil to reduce the generation of eddy currents in the case.

An electrically insulating material may be provided between the case and the movable coil to enhance insulating properties.

A ferromagnetic core may be disposed in the case in a location surrounded by the movable coil to increase the magnetic field generated by the movable coil.

The case may include a hub at a radially inner portion thereof to increase the bending stiffness of the case. In a preferred embodiment, the case includes a plurality of projections extending radially from the hub, with each projection extending into a ferromagnetic core. An electrically insulating material may be disposed between the hub, the projections, and the core.

In a preferred embodiment, the thickness of the case in its axial direction is greater at a radially inner portion thereof than at a radially outer portion thereof.

In another preferred embodiment, the case has a thickness on a side thereof which opposes a fixed coil which is smaller than a thickness on the opposite side of the case.

DETAILED DESCRIPTION

Figure 1:
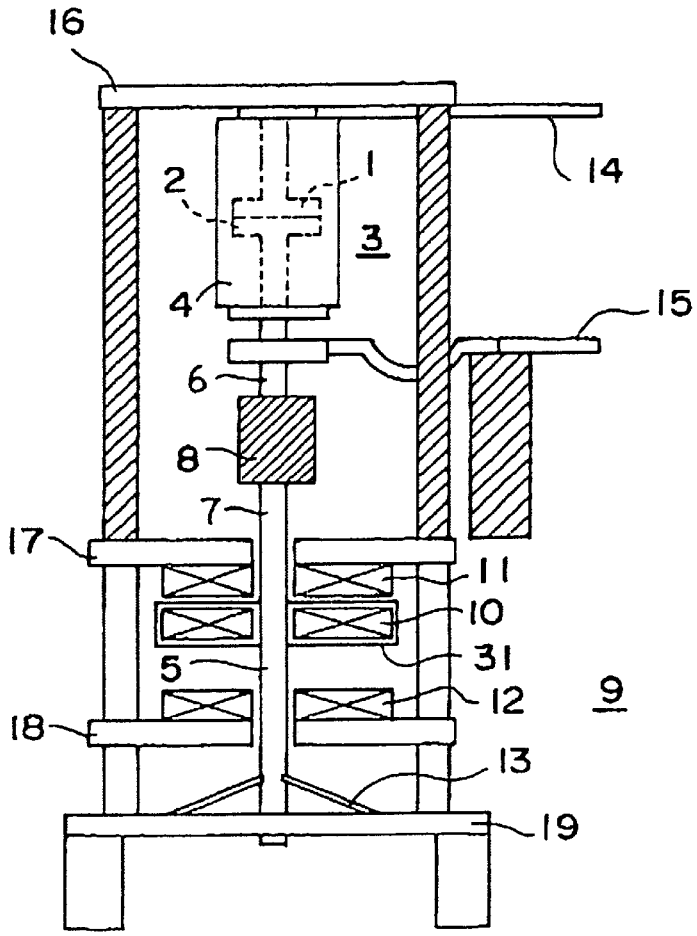
FIG. 1 is a schematic partially cross-sectional elevation of a first embodiment of a switching device according to the present invention.
Figure 2:
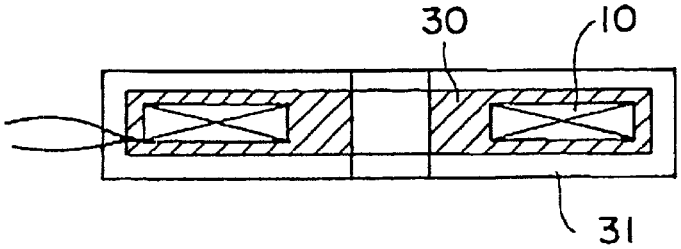
FIG. 2 is an enlarged cross-sectional elevation of the movable coil of the embodiment of FIG. 1.
Figure 3B:
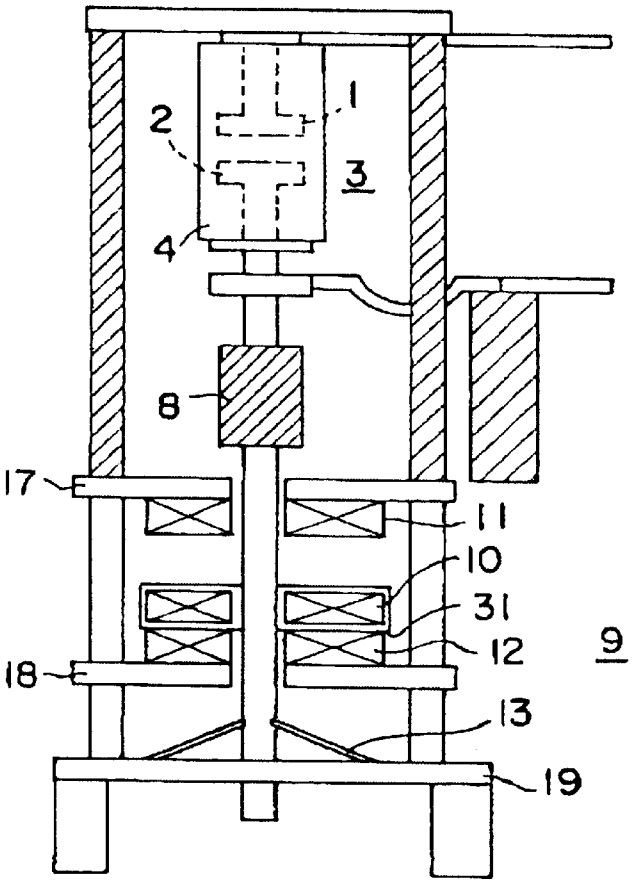
FIGS. 3*a* and 3*b* are schematic partially cross-sectional elevations of the embodiment of FIG. 1 in a closed contact state and an open contact state, respectively.
Figure 3A:
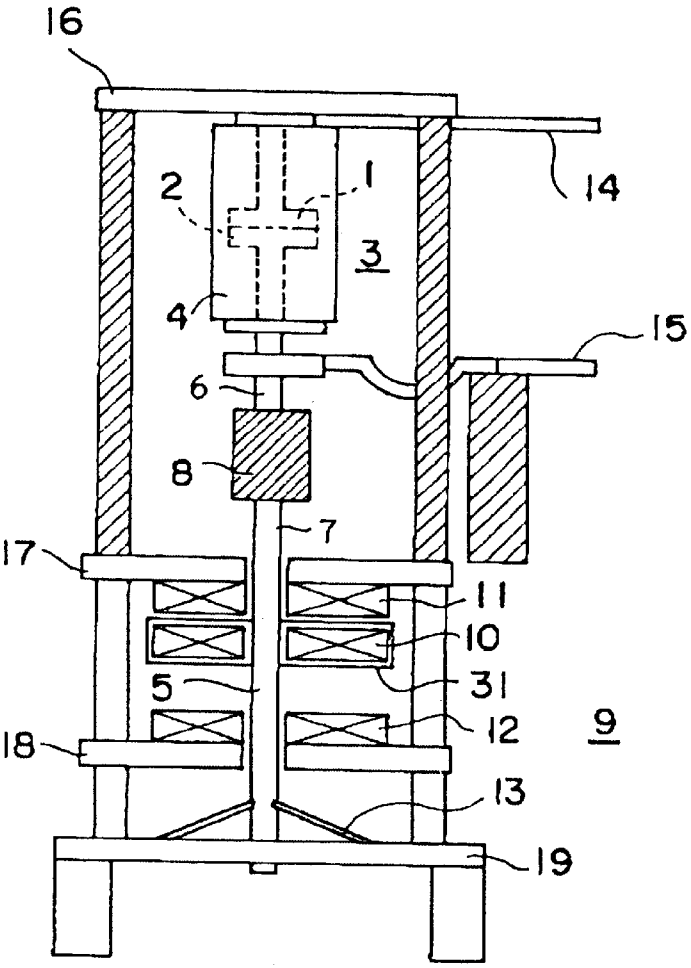
Figure 10B:
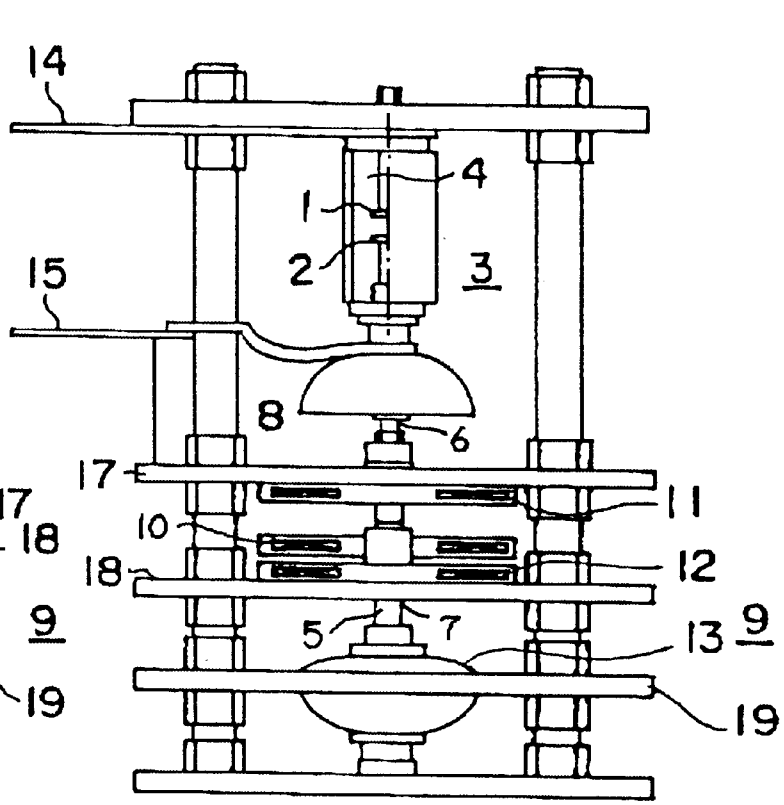
FIG. 10b PRIOR ART
FIGS. 10*a* and 10*b* are schematic cutaway elevations of a switching device known to the inventors in a closed contact state and an open contact state, respectively.
Figure 10A:
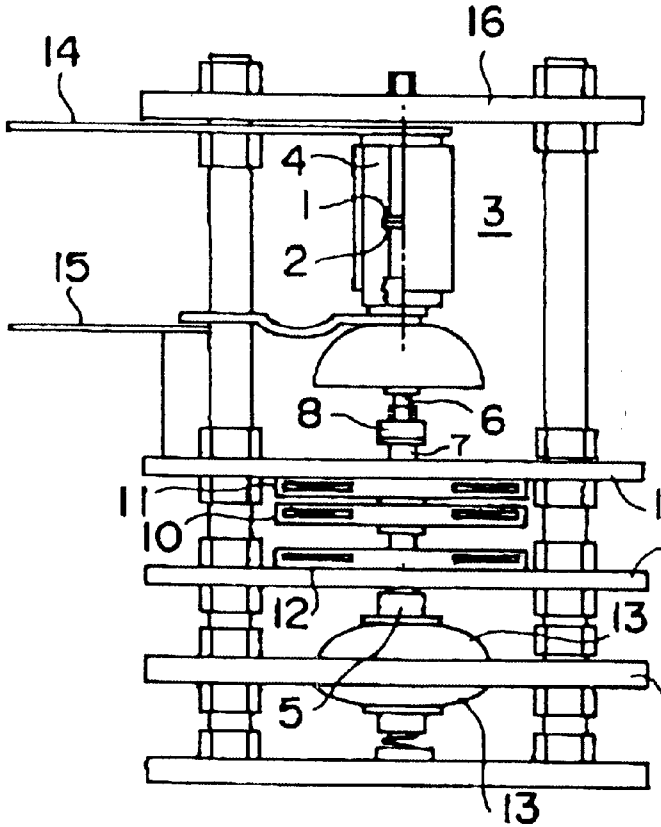
FIG. 10a PRIOR ART

FIGS. 1–3 illustrate a first embodiment of a switching device according to the present invention. FIG. 1 is a schematic partially cross-sectional elevation of this embodiment, FIG. 2 is an enlarged cross-sectional elevation of the movable coil of the embodiment of FIG. 1, and FIGS. 3*a* and 3*b* are schematic partially cross-sectional elevations of the embodiment of FIG. 1 in a closed contact state and an open contact state, respectively. Like the switching device of FIGS. 10*a* and 10*b*, this embodiment includes a switch portion 3 which can open and close an electric circuit, a movable shaft 5 which transmits a drive force to the switch portion 3, and an operating mechanism 9 Which is driven by an unillustrated electric power supply and applies a drive force to the movable shaft 5 to open and close the switch portion 3.

The switch portion 3 has a fixed contact 1 which is secured to a support plate 16 which is part of an outer frame of the switching device, and a movable contact 2 which is disposed opposite the fixed contact 1. A first terminal 14 is electrically connected to the fixed contact 1, and a second terminal 15 is electrically connected to the movable contact 2. The first and second terminals 14 and 15 enable the switch portion 3 to be electrically connected to an external electric circuit. The movable electrode 2 can move in the vertical direction in FIG. 1 to contact and separate from the fixed electrode 1 and carry out contact closing or contact opening of the switch portion 3.

The movable shaft 5 includes a live portion 6 connected to the movable contact 2 and a non-live portion 7 connected to the operating mechanism 9. The live portion 6 and the non-live portion 7 are connected to and electrically insulated from each other by an electrically insulating rod 8 which prevents current from flowing from the switch portion 3 to the operating mechanism 9.

The operating mechanism 9 includes a contact opening fixed coil 11 secured to a stationary support plate 17 through which the movable shaft 5 loosely passes, a contact closing fixed coil 12 secured to a stationary support plate 18 through which the movable shaft 5 also loosely passes, a movable coil 10 which is disposed between the contact opening fixed coil 11 and the contact closing fixed coil 12 and which is secured to the movable shaft 5, and a biasing spring 13 which is secured to a support plate 19 and to the movable shaft 5. The movable coil 10 has a flat shape, which makes it strongly influenced by bending moments due to inertial forces caused by movement of the movable coil 10 and due to impact forces caused by collision between the movable coil 10 and the fixed coils 11 and 12. However, the flat shaft is advantageous in that it enables the diameter of the movable coil 10 to be large enough for the movable coil 10 to generate an adequate magnetic flux, and it also permits a small center-to-center distance between the movable coil 10 and the fixed coils 11 and 12 so that a large electromagnetic repulsive force can be efficiently generated. A particularly preferred range for the outer diameter of the movable coil 10 is approximately 9–11 times its thickness, since in this range an electromagnetic repulsive force can be generated particularly efficiently. If a movable coil 10 with a flat shape of this type is used, the response speed during operation can be reduced from a conventional value on the order of 2–3 msec down to 1 msec. In order to enable the movable coil 10 to have a large diameter without being subjected to undesirable levels of stress or deformation, the operating mechanism 9 includes a stiffener for stiffening the movable coil 10 against force acting in the axial direction of the switching device. In the present embodiment, as shown in FIG. 2, the stiffener includes a resin 30 which is molded around the movable coil 10 to harden the movable coil 10, and a case 31 of a nonmagnetic metal (such as AISI Type 304 stainless steel) which surrounds the movable coil 10 and the movable shaft 5. The operating mechanism 9 also includes a non-linear biasing spring 13 which changes the direction in which it exerts a biasing force depending upon the position of the movable shaft 5. When the switching device is in a closed contact state, the biasing spring 13 exerts a biasing force on the movable shaft 5 in the contact closing direction (upwards in FIG. 1), and when the switching device is in an open contact state, the biasing spring 13 exerts a biasing force in the contact opening direction (downwards in the figure).

Next, contact opening operation will be explained. When the switching device is in the closed contact state shown in FIG. 3*a,* if a pulse current is supplied to the contact opening fixed coil 11 and the movable coil 10 by an unillustrated power supply, each coil 11 and 10 generates a magnetic field. The coils 10 and 11 are urged away from each other by electromagnetic repulsive forces produced by the magnetic fields, and the movable coil 10 is pushed rapidly downwards in the figure by the electromagnetic repulsive forces, as is the movable shaft 5 which is secured to the movable coil 10. The downwards movement of the movable shaft 5 separates the movable contact 2 from the fixed contact 1 to open the switch portion 3. When the movable shaft 5 moves downwards past a prescribed point, the biasing spring 13 is inverted, and the direction in which it applies a biasing force to the movable shaft 5 changes to downwards in the figure to maintain the open contact state shown in FIG. 3*b.*

Next, contact closing operation will be explained. When the switching device is in the open contact state shown in FIG. 3*b,* if a pulse current is supplied to the contact closing fixed coil 12 and the movable coil 10, coils 12 and 10 generate magnetic fields. The coils 10 and 12 are urged away from each other by electromagnetic repulsive forces resulting from the magnetic fields, and the movable coil 10 is pushed rapidly upwards in the figure, as is the movable shaft 5 which is secured to the movable coil 10. When the movable shaft 5 moves upwards past a prescribed point, the biasing spring 13 is inverted, and the direction in which it applies a biasing force to the movable shaft 5 changes to upwards in the figure. The upward movement of the movable shaft 5 brings the movable contact 2 into contact with the fixed contact 1 to close the switch portion 3. The closed contact state shown in FIG. 3*a* is maintained by the upwards force exerted by the biasing spring 13.

The movable coil 10 is stiffened by the molded resin 30, which hardens the movable coil 10, and by the case 31 in which the movable coil 10 and the resin 30 are housed, so it is able to withstand the bending moments which are applied to it due to inertial forces in the axial direction as well as due to impact forces while possessing the advantages of a flat shape, i.e., a low center-to-center distance from the fixed coils 11 and 12 and an ability of generate electromagnetic repulsive forces with high efficiency. Thus, it does not suffer from the structural weaknesses which are typical of a flat coil.

Stainless steel is advantageous as a material for the case 31 because it has a high strength and a low magnetic permeability, so it does not impede the convergence of magnetic force lines.

Materials other than a molded resin 30 can be used to stiffen the movable coil 10, such as varnish or nylon or a glass-containing material which is applied to the movable coil 10. It is also possible for the movable coil 10 to be housed in the case 31 without the use of a molded resin 30 or similar stiffening material.

If a molded resin 30, varnish, or similar stiffening material can provide the movable coil 10 with sufficient stiffness, the case 31 may be omitted.

A case 31 for housing the movable coil 10 is not limited to one made of AISI Type 304 stainless steel. For example, it can be made of another nonmagnetic stainless steel, or a nonmagnetic metal other than stainless steel, or a nonmagnetic material other than a metal, such as an epoxy resin or other polymeric material.

It may be advantageous to dispose an electrically insulating material between the case 31 and the movable coil 10 to prevent insulating breakdown of the movable coil 10 and increase the reliability of the movable coil 10.

It may also be advantageous to install a ferromagnetic core, such as a ferromagnetic core, on the radially inner side of the movable coil 10, where it is surrounded by the movable coil 10, to increase the magnetic flux density.

Figure 4:
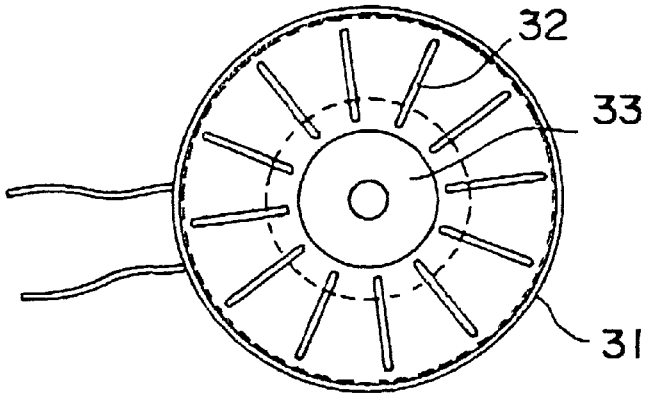
FIG. 4 is a plan view of a case for a movable coil of a second embodiment of a switching device according to the present invention.

FIG. 4 is a plan view of a case 31 for housing a movable coil 10 of a second embodiment of a switching device according to the present invention. This case 31 is similar to the case 31 shown in FIG. 2 and like that case 31, it is made of a nonmagnetic metal, but it further includes a plurality of radially-extending slits 32 formed in its top and bottom surfaces. A movable coil 10 surrounded by a molded resin 30 is housed in the case 31 in the same manner as shown in FIG. 2. A ferromagnetic core 33 is secured at the radially inner portion of the movable coil 10. The structure of this embodiment is otherwise the same as that of the embodiment of FIG. 1.

The radially extending slits 32 in the top and bottom surfaces of the case 31 reduce the generation of eddy currents in these surfaces, so eddy current losses can be decreased.

The core 33 which is installed on the radially inner side of the movable coil 10 concentrates magnetic flux, so electromagnetic force can be efficiently generated.

The slits 32 in the top and bottom surfaces of the case 31 can be replaced by radially-extending grooves formed only partway through the thickness of each surface. Like slits 32, grooves can reduce eddy current losses in the case 31, and since they extend only partway through the thickness of a surface in which they are formed, they do not decrease the rigidity of the case 31 as much as slits 32 of the same dimensions.

Figure 5:
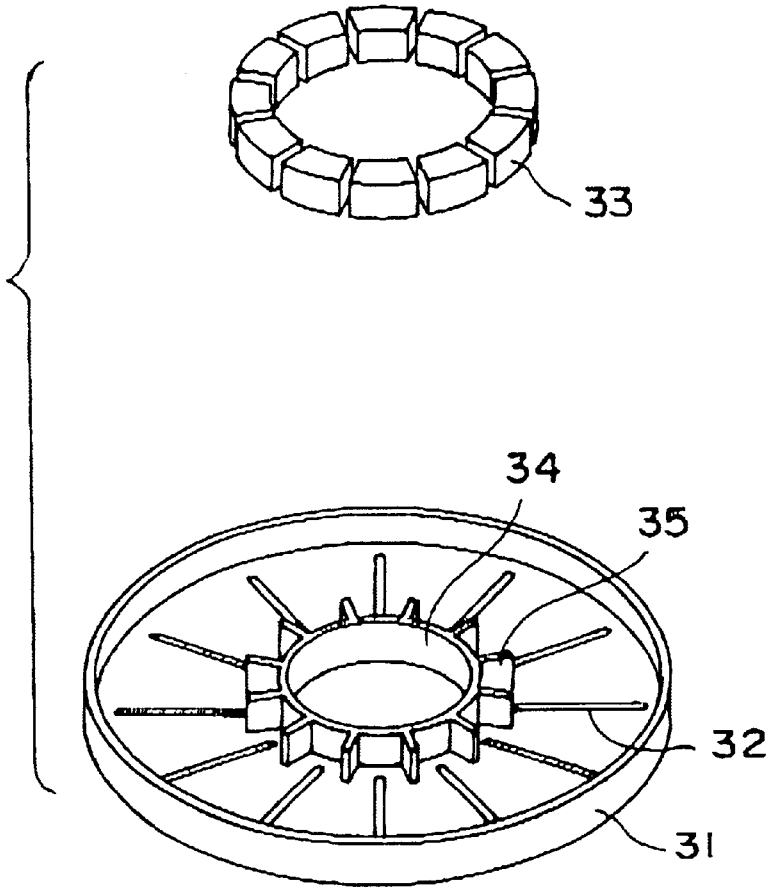
FIG. 5 is an exploded axonometric view of a case and a ferromagnetic core for a movable coil of a third embodiment of a switching device according to the present invention.
Figure 6:
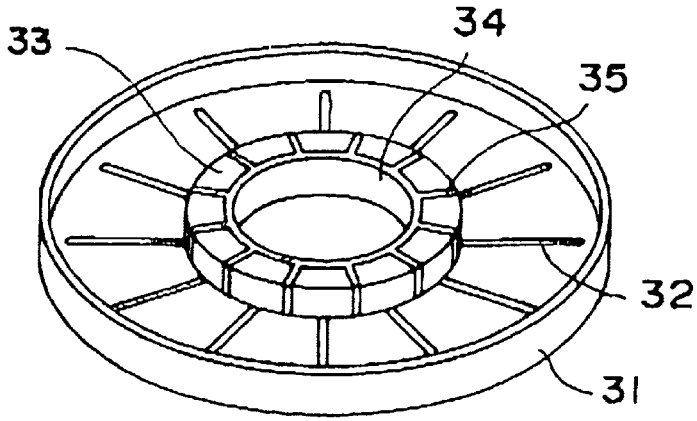
FIG. 6 is axonometric view of the case and the ferromagnetic core shown in FIG. 5 in an assembled state.

FIG. 5 is an exploded axonometric view of a case 31 and a ferromagnetic core 33 for use with a movable coil of a third embodiment of a switching device according to the present invention, and FIG. 6 is an axonometric view of the case 31 and the core 33 of FIG. 5 in an assembled state. The illustrated case 31 has an axially-extending cylindrical hub 34 at its radially inner portion, and a plurality of projections 35 are secured to and extend radially outwards from the hub 34. A ferromagnetic core 33 is disposed around the hub 34 and is secured in place, with the projections 35 extending radially into the core 33. The core 33 can have a variety of configurations. In the present embodiment, the core 33 comprises a plurality of separate arcuate pieces each comprising a sector of an annulus. Each piece fits between two adjoining projections 35. When the case 31 is assembled, the radially outer periphery of the core 33 is surrounded by an unillustrated movable coil 10, which may have the same structure as described with respect to the previous embodiments. The structure of this embodiment is otherwise the same as that of the embodiment of FIG. 1, and it performs switching operation in the same manner as that embodiment.

The hub 34 increases the rigidity of the case 31 and thereby increases the resistance of the movable coil 10 to stresses and bending moments at the radially inner portion thereof.

Figure 7:
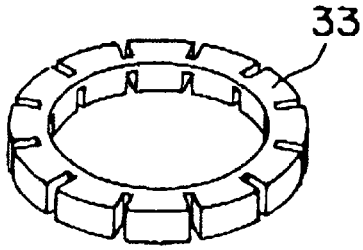
FIG. 7 is an axonometric view of another example of a ferromagnetic core which can be employed with a movable coil of a switching device according to the present invention.

The multi-piece ferromagnetic core 33 shown in FIG. 5 is advantageous in that it can reduce eddy current losses. However, other configurations can also be used for a ferromagnetic core. FIG. 7 is an axonometric view of another example of a ferromagnetic core 33 which can be used in the present invention. This core 33 is a one-piece ring having a plurality of radially-extending slits which extend partway through the cross section of the core 33. The slits decrease eddy current losses in the core 33 while at the same time enabling the core 33 to be handled as a single piece, thereby reducing the number of components compared to the core 33 of FIG. 5.

The generation of eddy currents can be decreased with greater certainty by inserting an electrically insulating paper or other electrically insulating material between the hub 34, the projections 35, and the ferromagnetic core 33.

Figure 8:
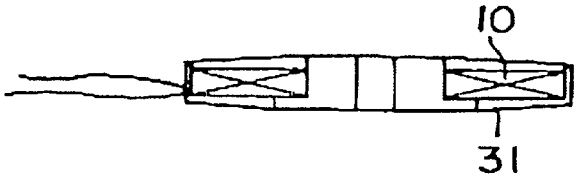
FIG. 8 is a cross-sectional elevation of a movable coil and a case of a fourth embodiment of a switching device according to the present invention.

FIG. 8 is a cross-sectional elevation of a case 31 for a movable coil 10 of a fourth embodiment of a switching device according to the present invention. As shown in FIG. 8, this case 31 has a greater thickness measured in its axial direction at its radially inner portion than at its radially outer portion. The structure of this embodiment is otherwise the same as that of the first embodiment.

With this structure, the strength of the radially inner portion of the case 31 which is subjected to the greatest bending moments due to inertial forces and impacts during opening and closing operation, is increased, so the rigidity of the movable coil 10 is increased, and the reliability of the switching device is also increased.

Figure 9:
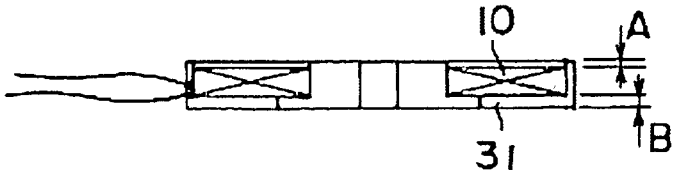
FIG. 9 is a cross-sectional elevation of a movable coil and a case of a fifth embodiment of a switching device according to the present invention.

FIG. 9 is a cross-sectional elevation of a case 31 for a movable coil 10 of a fifth embodiment of a switching device according to this invention. In this embodiment, the thickness A of the case 31 on the upper surface is smaller than the thickness B on the opposite surface of the case 31. The structure of this embodiment is otherwise the same as that of the first embodiment.

With this structure, the distance between the movable coil 10 and a fixed coil opposing its top side is decreased, so electromagnetic repulsive forces can be more efficiently generated.

Thickness B is larger than thickness A, so the rigidity of the movable coil 10 itself can be increased.

In each of the above-described embodiments, in order to prevent insulating breakdown with certainty, an electrically insulating material can be disposed between the case 31 and the movable coil 10 housed in the case 31.

As is clear from the above description, the present invention can provide benefits such as the following:

(1) A switching device has a movable coil which is equipped with a coil stiffener for increasing the stiffness of the movable coil. Therefore, the movable coil can withstand the forces experienced during high speed operation without damage, and a highly reliable switching device with good responsiveness can be obtained.

(2) By forming the movable coil with an outer diameter which is approximately 9–11 times its thickness, a switching device can be obtained which can efficiently generate an electromagnetic repulsive force and which has a high response speed.

(3) In one form of the invention, the coil stiffener comprises a resin molded around the movable coil or a varnish applied to the movable coil. Therefore, a movable coil which is light yet has high rigidity can be manufactured, and a switching device with good responsiveness and high reliability can be obtained.

(4) In another form of the invention, the coil stiffener includes a case which houses the movable coil. Therefore, a movable coil which is light yet has high rigidity can be manufactured, and a switching device with good responsiveness and high reliability can be obtained.

(5) In preferred embodiments, the case comprises a non-magnetic material. Therefore, a movable coil which is light and has high rigidity can be manufactured, dispersion of magnetic flux by the case can be prevented, and a switching device can be obtained which makes it possible to generate electromagnetic force with good efficiency.

(6) In a preferred embodiment, the case has radially extending slits or grooves formed in a surface of the case opposing a fixed coil. Therefore, eddy current losses by the case can be suppressed, and a switching device which can efficiently generate electromagnetic force and which has good responsiveness can be obtained.

(7) An electrically insulating material may be disposed between the case and the movable coil. Therefore, breakdown of insulation between the movable coil and the case due to impact caused by high speed operation can be prevented, and a switching device of high reliability and safety can be obtained.

(8) A ferromagnetic core may be provided on the radially inner side of the movable coil. Therefore, the flux density can be efficiently increased, and a switching device can be obtained which can generate a high electromagnetic repulsive force and which has a high response speed and which can perform contact opening operation or contact closing operation with certainty.

(9) The case may include a hub on the radially inner side of the case. The hub increases the rigidity of the case, and a switching device can be obtained which can withstand impact forces and has high reliability.

(10) The hub may be equipped with a plurality of radially extending projections which extend into the core. Therefore, the rigidity of the movable coil is increased, eddy currents generated in the core can be interrupted by the projections, and eddy current losses can be made small. At the same time a switching device can be obtained which can efficiently increase the flux density.

(11) An electrically insulating material may be disposed between the hub and the core. Therefore, eddy currents which are generated in the ferromagnetic core can be interrupted with certainty, and a switching device can be obtained which decreases eddy current losses.

(12) In a preferred embodiment, the case has a thickness in the axial direction which is larger on its radially inner side than on its radially outer side. Therefore, the radially inner side of the case to which the largest stresses and moments are applied can be reinforced, and a switching device can be obtained which has a movable coil which can efficiently withstand stresses and moments.

(13) In another preferred embodiment, the case has a thickness which is smaller on a side facing a fixed coil than on the opposite side of the case. Therefore, the distance from the movable coil to a fixed coil can be decreased while maintaining the stiffness of the movable coil, and a switching device can be obtained which can efficiently generate an electromagnetic force and which has good responsiveness.

What is claimed is:

1. A switching device comprising:

a switch having a fixed contact and a movable contact, is movable with respect to the fixed contact, between an open position and a closed position to open and close the switch;

a movable shaft drivingly connected to the movable contact; and an operating mechanism drivingly connected to the movable shaft and moving the movable shaft to open and close the switch and including a flat movable coil operatively connected to the movable shaft, a fixed coil opposing the movable coil, and a coil stiffener increasing stiffness of the movable coil against forces in an axial direction of the movable shaft, wherein the coil stiffener comprises a resin molded around the movable coil.

2. The switching device as claimed in claim 1, wherein the movable coil has a thickness and an outer diameter, the outer diameter being approximately 9–11 times the thickness of the movable coil.

3. The switching device as claimed in claim 1, including a ferromagnetic core surrounded by the movable coil.

4. A switching device comprising:

a switch having a fixed contact and a movable contact, movable with respect to the fixed contact, between an open position and a closed position to open and close the switch;

a movable shaft drivingly connected to the movable contact; and an operating mechanism drivingly connected to the movable shaft and moving the movable shaft to open and close the switch and including a flat movable coil operatively connected to the movable shaft, a fixed coil opposing the movable coil, and a coil stiffener increasing stiffness of the movable coil against forces in an axial direction of the movable shaft, wherein the coil stiffener comprises varnish applied to the movable coil.

5. The switching device as claimed in claim 4, wherein the movable coil has a thickness and an outer diameter, the outer diameter being approximately 9–11 times the thickness of the movable coil.

6. The switching device as claimed in claim 4, including a ferromagnetic core surrounded by the movable coil.

7. A switching device comprising:

a switch having a fixed contact and a movable contact, movable with respect to the fixed contact, between an open position and a closed position to open and close the switch;

a movable shaft drivingly connected to the movable contact; and an operating mechanism drivingly connected to the movable shaft and moving the movable shaft to open and close the switch and including a flat movable coil operatively connected to the movable shaft, a fixed coil opposing the movable coil, and a coil stiffener increasing stiffness of the movable coil against forces in an axial direction of the movable shaft, wherein the coil stiffener comprises a non-magnetic metal case containing the movable coil.

8. The switching device as claimed in claim 7, wherein the case has radially extending slits in a surface which opposes the fixed coil.

9. The switching device as claimed in claim 7, wherein the case has radially-extending grooves in a surface which opposes the fixed coil.

10. The switching device as claimed in claim 7, including an electrically insulating material disposed between the case and the movable coil.

11. The switching device as claimed in claim 7, wherein the case includes a hub disposed at an inner portion of the movable coil.

12. The switching device as claimed in claim 7, wherein the case has a thickness in an axial direction larger at a radially inner portion than at a radially outer portion.

13. The switching device as claimed in claim 7, wherein the case has a thickness on a side-which opposes the fixed coil which is smaller than thickness of an opposite side of the case.

14. The switching device as claimed in claim 7, wherein the movable coil has an outer diameter, the outer diameter being approximately 9–11 times the thickness of the movable coil.

15. The switching device as claimed is claim 7, including a ferromagnetic core surrounded by the movable coil.

16. The switching device as claimed in claim 15, wherein the case includes a hub disposed at an inner portion of the movable coil and a plurality of projections extending radially from the hub, each projection extending into the core.

17. The switching device as claimed in claim 16, including an electrically insulating material disposed between the hub and the core.

* * * * *